US009877538B2

(12) United States Patent
Kim

(10) Patent No.: US 9,877,538 B2
(45) Date of Patent: Jan. 30, 2018

(54) VENTILATED SHOE

(71) Applicant: Nahyun Kim, Forest Hills, NY (US)

(72) Inventor: Nahyun Kim, Forest Hills, NY (US)

( * ) Notice: Subject to any disclaimer, the term of this patent is extended or adjusted under 35 U.S.C. 154(b) by 199 days.

(21) Appl. No.: 14/935,957

(22) Filed: Nov. 9, 2015

(65) Prior Publication Data

US 2017/0127751 A1 May 11, 2017

(51) Int. Cl.
*A43B 7/08* (2006.01)
*A43B 13/14* (2006.01)

(52) U.S. Cl.
CPC ..... *A43B 7/08* (2013.01); *A43B 13/14* (2013.01)

(58) Field of Classification Search
CPC .. A43B 7/06; A43B 7/08; A43B 7/081; A43B 7/082; A43B 7/084; A43B 7/088; A43B 7/10; A43B 17/08; A43B 7/146; A43B 1/0045; A43B 13/14
USPC ..... 36/3 B, 3 R, 141, 147
See application file for complete search history.

(56) References Cited

U.S. PATENT DOCUMENTS 2,751,692 A * 6/1956 Cortina ..... A43B 7/06 36/3 B
3,180,039 A 4/1965 Burns, Jr.
3,225,463 A 12/1965 Burnham
3,716,930 A 2/1973 Brahm
4,215,492 A 8/1980 Sandmeier
4,223,455 A 9/1980 Vermeulen
4,364,186 A 12/1982 Fukuoka
4,499,672 A 2/1985 Kim
4,590,689 A 5/1986 Rosenberg
4,602,441 A 7/1986 El Sakkaf
4,654,982 A 4/1987 Lee
4,674,203 A 6/1987 Goller
4,685,224 A 8/1987 Anger
4,760,651 A 8/1988 Pon-Tzu
4,776,109 A 10/1988 Sacre
4,831,749 A 5/1989 Tsai
4,837,948 A * 6/1989 Cho ..... A43B 7/082 36/3 A
4,860,463 A 8/1989 Pin
4,910,882 A * 3/1990 Goller ..... A43B 17/08 36/141
5,010,661 A 4/1991 Chu
5,035,068 A 7/1991 Biasi
5,090,139 A * 2/1992 Germann ..... A43B 5/0417 36/117.5
5,167,999 A 12/1992 Wang
5,224,277 A 7/1993 Sang Do
(Continued)

*Primary Examiner* — Khoa Huynh
*Assistant Examiner* — Griffin Hall
(74) *Attorney, Agent, or Firm* — Rabin & Berdo, P.C.

(57) ABSTRACT

A ventilated shoe is provided. The ventilation shoe includes a bottom pad (10) with a peripheral wall (11) that has a front part (12), a rear part (13), a right side part (14) and a left side part (15). A plurality of right and left side holes (142, 152) are formed in the right and left side parts (14, 15) of the peripheral wall (11). A ventilation pad (20) is disposed on the bottom pad (10) to be surrounded by the peripheral wall (11), in a wave-like layer with alternate crests (21) and troughs (22), forming a plurality of tunnel vaults (23) each of which extends from the right side part (14) to the left side part (15). A right belt (30) and a left belt (40) are disposed on the right and left side parts (14, 15) of the peripheral wall (11) to be slidable between two positions.

21 Claims, 8 Drawing Sheets

(56) References Cited

U.S. PATENT DOCUMENTS

| | | | | |
|---|---|---|---|---|
| 5,282,324 | A | 2/1994 | Cheng | |
| 5,341,581 | A | 8/1994 | Huang | |
| 5,400,526 | A | 3/1995 | Sessa | |
| 5,606,806 | A | 3/1997 | O'Dwyer | |
| 5,607,749 | A | 3/1997 | Strumor | |
| 5,619,809 | A | 4/1997 | Sessa | |
| 5,669,161 | A | 9/1997 | Huang | |
| 5,675,914 | A | 10/1997 | Cintron | |
| 5,694,705 | A | 12/1997 | Coves et al. | |
| 5,787,609 | A | 8/1998 | Wu | |
| 5,809,665 | A | 9/1998 | Suenaga | |
| 5,813,141 | A | 9/1998 | Cho | |
| 5,815,949 | A | 10/1998 | Sessa | |
| 5,826,349 | A | 10/1998 | Goss | |
| 5,845,418 | A | 12/1998 | Chi | |
| 5,979,076 | A * | 11/1999 | Li | A43B 1/0045 36/141 |
| 6,305,100 | B1 | 10/2001 | Komarnycky et al. | |
| 6,655,048 | B2 * | 12/2003 | Moretti | A43B 7/125 36/29 |
| 6,675,501 | B2 * | 1/2004 | Pfander | A43B 7/144 36/141 |
| 6,874,252 | B2 | 4/2005 | Nakano | |
| 8,713,816 | B2 * | 5/2014 | Al-Sabah | A43B 1/0045 36/3 A |
| 9,480,297 | B2 * | 11/2016 | Kim | A43B 7/088 |
| 2008/0178496 | A1 * | 7/2008 | Lin | A43B 7/125 36/30 R |
| 2009/0293306 | A1 * | 12/2009 | Sedelmeier | A43B 7/081 36/88 |
| 2011/0162240 | A1 * | 7/2011 | Pieri | A43B 7/082 36/3 B |
| 2013/0000157 | A1 * | 1/2013 | Wu | A43B 13/12 36/30 A |
| 2014/0013631 | A1 * | 1/2014 | Kim | A43B 17/02 36/25 R |
| 2015/0223555 | A1 * | 8/2015 | Choi | A43B 7/088 36/3 B |

* cited by examiner

VENTILATED SHOE

BACKGROUND OF THE INVENTION

1. Field of the Invention

The present invention relates to a shoe, more specifically, a ventilated shoe that promotes air flow to the feet for ventilation.

2. Background Information

Shoes or Footwear has traditionally been designed to protect the wearer's feet from heat, cold, and trauma. The modern consumer expects to take long walks without suffering foot fatigue or irritation. Another important function of modern shoes is to provide cushion support so that the wearer can walk, run, and jump with minimal impact upon joints and vertebrae. However, despite having all these needs met, the modern consumer is still unsatisfied with the lack of ventilation to the feet that is prevalent in modern shoes.

The skin of the human foot exudes perspiration, as well as odors, in varying degrees, depending upon such factors as temperature of the ambient, the amount of physical activity being performed, and the natural propensity of the particular person to perspire. The comfort and health of the human foot is greatly influenced by the rate of evaporation of the perspiration generated as a result of movement and/or physical exercise. Thus, the restrictive nature of the modern shoes promotes offensive foot odor due to lack of ventilation. This problem has been acknowledged by shoe designers and has been addressed with varying degrees of failure in many different ways over the past decades.

One way of providing more ventilation to the feet is with soles and footpads that employ various interconnected pumping chambers, bladders, valves, jets, tubes, orifices, and the like. Patents exemplifying this approach include U.S. Pat. Nos. 3,180,039; 3,225,463; 4,215,492; 4,499,672; 4,654,982; 4,760,651; 4,776,109; 4,860,463; 5,010,661; 5,224,277; 5,282,324; 5,341,581; 5,606,806; 5,787,609; 5,809,665; 5,815,949; 5,813,141; and 5,826,349. These patents, for the most part, teach products that use the motion of the feet while walking to agitate or exchange air surrounding the foot.

Another approach attempted several times is to use compressible supporting structures situated in a space defined between the upper and lower layers of a footpad or insole. Patents teaching this approach include U.S. Pat. Nos. 3,716,930; 4,223,455; 4,364,186; 4,590,689; 4,674,203; 4,910,882; 5,035,068; 5,619,809; 5,669,161; 5,675,914; and 5,845,418.

A third approach involves the use of ribs, beads, liquid cells, knobs, or nipples to ventilate. Patents that teach this approach include U.S. Pat. Nos. 4,685,224; 4,831,749; 5,167,999; 5,607,749; and 5,694,705.

Despite the vast number of approaches, the need persists for improved ventilated shoes which deliver proper ventilation to the feet while providing support for walking, shock absorption, and comfortable static support. In this regard, the present invention substantially fulfills this need.

SUMMARY OF THE INVENTION

Accordingly, the present invention has been made in view of the above-mentioned disadvantages occurring in the prior art. It is therefore an object of the present invention to provide a ventilated shoe which can maximize air flow to the feet of the wearer. The present invention also aims to provide a ventilated show which can adjust and control the amount of the air flow.

According to one aspect of the invention, the shoe includes a bottom pad with a peripheral wall that has a front part, a rear part opposite to the front part, a right side part and a left side part opposite to the right side part. A plurality of right side holes are formed in the right side part of the peripheral wall, and a plurality of left side holes are formed in the left side part of the peripheral wall.

The shoe of the present invention further includes a ventilation pad is disposed on the bottom pad to be surrounded by the peripheral wall. The ventilation pad forms a wave-like layer with alternate crests and troughs while the ventilation pad extends from the front part to the rear part without discontinuity. The troughs or lower portions of the wave-like layer are fixed to an upper surface of the bottom pad. Further, the wave-like layer forms a plurality of tunnels each of which extends from the right side part to the left side part, each tunnel having a plurality of slits.

The shoe of the present invention further includes a right belt disposed on the right side part of the peripheral wall. The right belt has right belt holes and is slidable between a first position where the right belt holes are aligned with the right side holes and are open to an outside of the shoe and a second position where the right belt holes are not aligned with the right side holes. The shoe of the present invention further includes a left belt which may be configured similar to the right belt.

DETAILED DESCRIPTION OF THE PREFERRED EMBODIMENTS

The invention will now be described in more detail by way of example with reference to the embodiments shown in the accompanying figures. It should be kept in mind that the following described embodiments are only presented by way of example and should not be construed as limiting the inventive concept to any particular physical configuration.

Further, if used and unless otherwise stated, the terms "right", "left", "upper", "lower", "front", "back", "over", "under", and similar such terms are not to be construed as limiting the invention to a particular orientation. Instead, these terms are used only on a relative basis.

Figure 1:
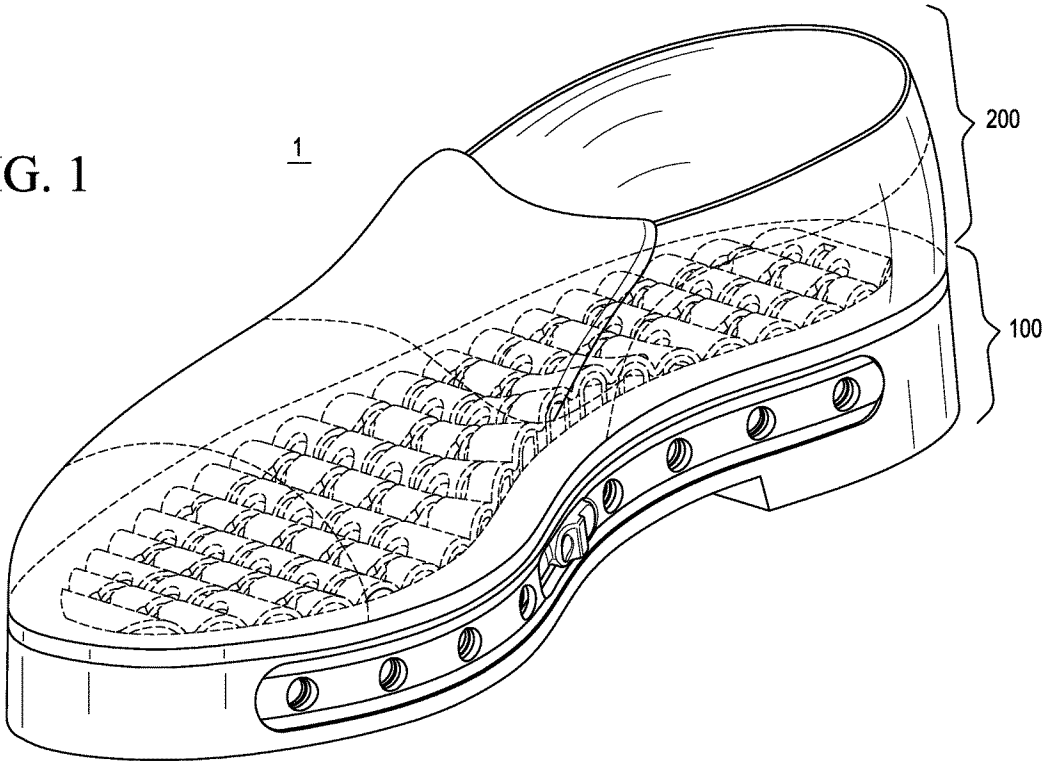
FIG. 1 is a schematic perspective view of a shoe, according to an exemplary embodiment of the present invention.

FIG. 1 is a schematic perspective view of a ventilated shoe 1, according to an exemplary embodiment of the present invention. The ventilated shoe 1 includes a lower section 100 forming the underside of the shoe 1 and an upper section 200.

Figure 2:
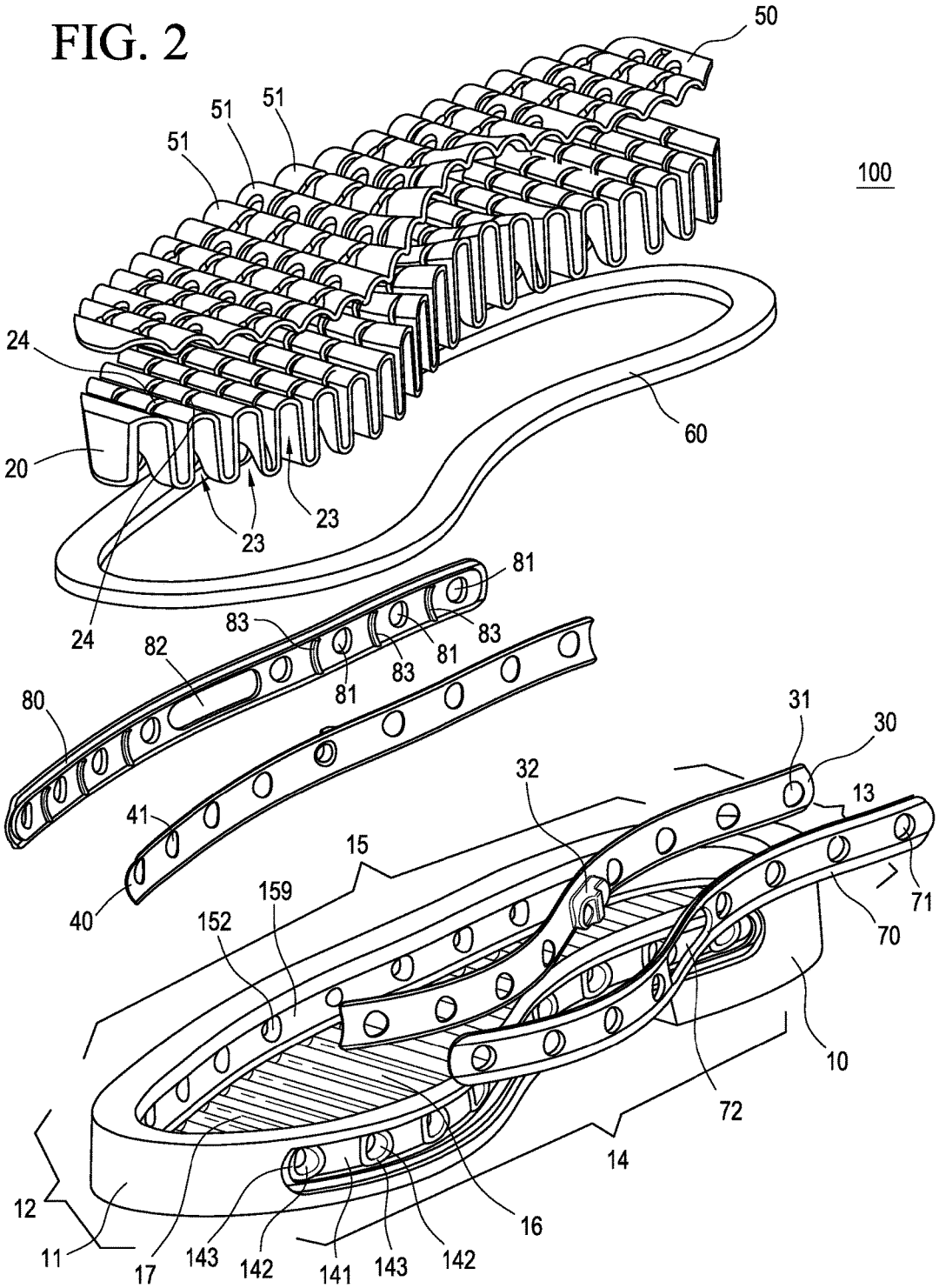
FIG. 2 is an exploded view, illustrating a configuration of a lower section of the shoe of the present invention.

FIG. 2 is an exploded view of the ventilated shoe 1. The upper section 200 of the shoe 1 is omitted from FIG. 2 for clear illustration of the structure of the lower section 100 of the shoe 1. The lower section 100 of the shoe 1 includes a bottom pad 10, a ventilation pad 20, a right belt 30 and a left belt 40. The bottom pad 10 includes a peripheral wall 11 which extends along a periphery of the bottom pad 10, defining an inner space surrounded by the peripheral wall 11.

The peripheral wall 11 includes a front part 12 which is disposed adjacent to a toe cap of the shoe 1 and a rear part 13 opposite to the front part 12. The peripheral wall 11 further includes a right side part 14 and a left side part 15 opposite to the right side part 14. The front part 12, the right side part 14, the rear part 13 and the left side part 15 are connected to each other in this order and collectively form a closed loop shape.

A plurality of right side holes 142 are formed in the right side part 14 of the peripheral wall 11, and a plurality of left side holes 152 are formed in the left side part 15 of the peripheral wall 11. Preferably, the right side part 14 may be configured to have a first depressed region 141 in which the right side holes 142 are formed. The first depressed region 141 functions as a belt guide which guides the right belt 30 to be coupled to the peripheral wall 11 and to slide on the right side part 14. Likewise, the left side part 15 may be configured to have a second depressed region 151 functioning as a belt guide (FIG. 5) in which the left side holes 152 are formed.

Figure 5:
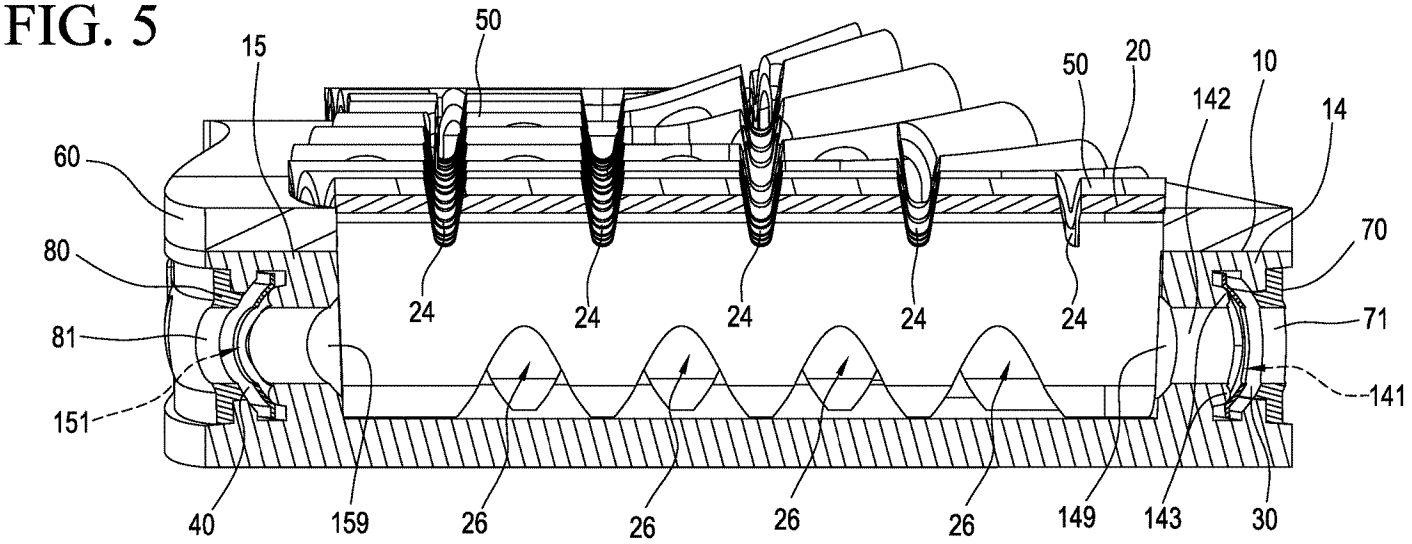
FIG. 5 is a schematic sectional view, taken along a line V-V of FIG. 3.

A plurality of right side O-rings 143 may be formed along the circumference of each of the right side holes 142, as shown in FIG. 2. The O-rings 143 come in contact with an inner surface of the right belt 30, as shown in FIG. 5. A plurality of left side O-rings may also be formed along the circumference of each of the left side holes 152.

The shoe 1 may further include a pad cover 50 and a welt 60, which will be explained in more detail later.

Figure 3:
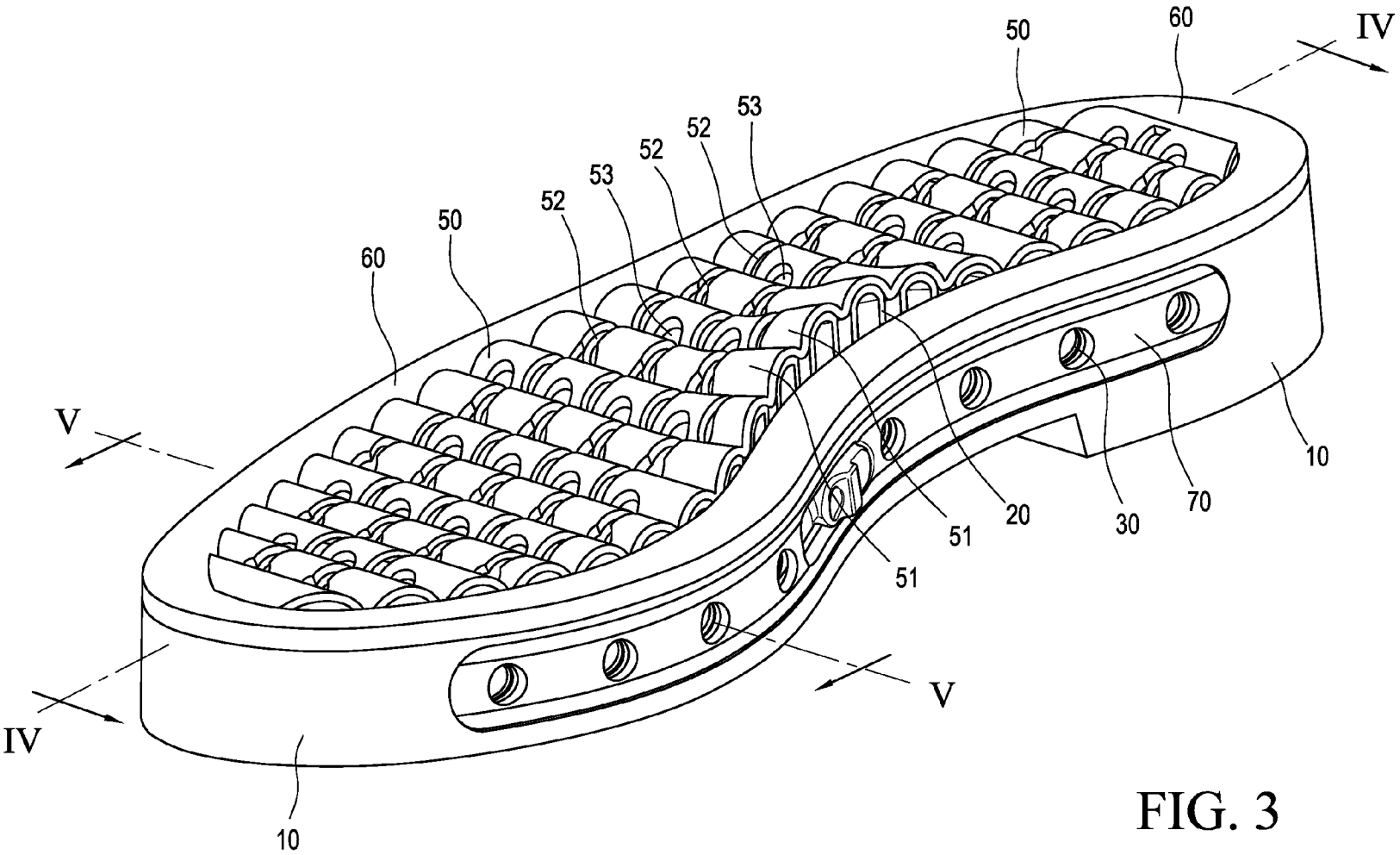
FIG. 3 is a perspective view, illustrating the lower section of the shoe shown in FIG. 2.

FIG. 3 is a perspective view, illustrating a lower section 100 of the shoe 1 in a state where the elements shown in the exploded view of FIG. 2 are assembled together. The ventilation pad 20 is disposed on an upper surface 16 of the bottom pad 10 to be surrounded by the peripheral wall 11. The ventilation pad 20 may be formed of materials including but not limited to rubber or plastic.

Figure 4:
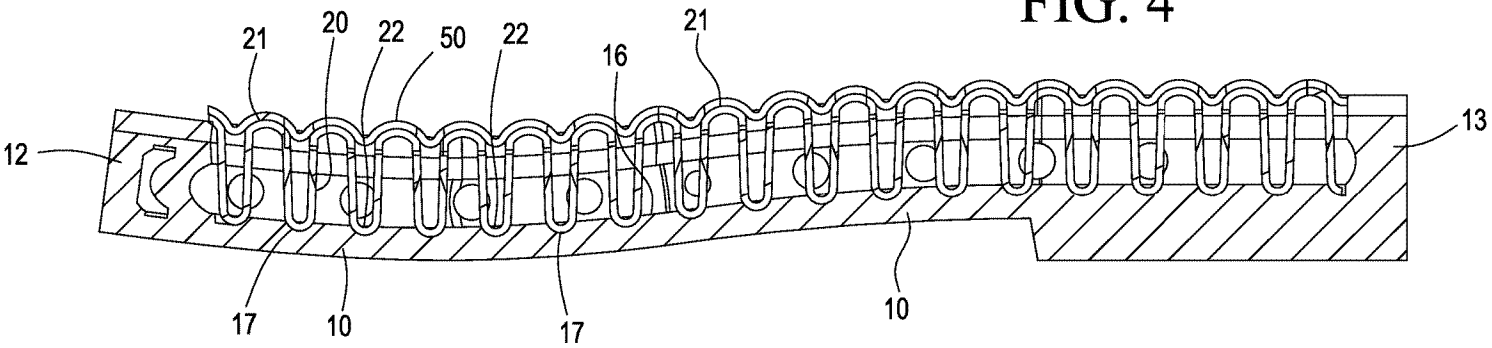
FIG. 4 is a schematic sectional view, taken along a line IV-IV of FIG. 3.
Figure 6A:
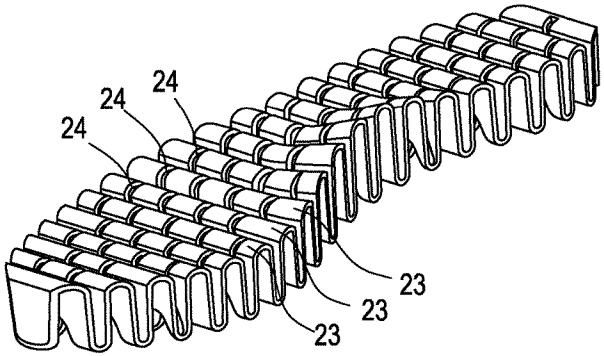
FIG. 6A is a perspective view of a ventilation pad of the shoe.

As shown in FIG. 4, which is a sectional view taken along a line IV-IV of FIG. 3, the ventilation pad 20 is formed as a wave-like layer in which a plurality of crests 21 and a plurality of troughs 22 are alternately formed. The wave-like layer extends from the front part 12 to the rear part 13 without discontinuity. The troughs 22 are fixed or attached to the upper surface 16 of the bottom pad 10. The wave-like layer forms a plurality of a tunnel vault 23 as shown in FIGS. 2 and 6A. Each tunnel vault 23 extends from the right side part 14 to the left side part 15. Each tunnel vault 23 has a plurality of slits 24 which connect an inside of the tunnel vault 23 to an outside of the tunnel vault 23.

The upper surface 16 of the bottom pad 10 may be configured to include a plurality of U shaped trenches 17 to facilitate the coupling of the ventilation pad 20 to the bottom pad 10. Specifically, as shown in FIG. 4, each downward part including the troughs 22 of the wave-like layer of ventilation pad 20 may be firmly received by the U shaped trenches 17.

FIG. 5 is a sectional view taken along a line V-V of FIG. 3. The ventilation pad 20 is disposed on the bottom pad 10 and surrounded by the peripheral wall 11 of the bottom pad 10. The right belt 30 is embedded in the first depressed region 141 of the right side part 14, and the left belt 40 is embedded in the second depressed region 151 of the left side part 15.

The inner surface of the right and left side parts 14 and 15 of the peripheral wall 11 may be configured to have a concave portion to form an air flow road. FIG. 5 shows air flow roads 149 and 159 which are respectively a space defined by the concaved portion of the inner surface of the wall 11 and the outer periphery of the ventilation pad 20. Air received from outside through the side holes 142 and 152 can flow in the air flow roads 149 and 150, and it can be smoothly provided toward the ventilation pad 20 via the air flow road 149 and 159.

The shoe 1 further includes a right belt cover 70 and a left belt cover 80, as shown in FIG. 2. The right belt cover 70 is attached to the right side part 14 to cover the right belt 30, and the left belt cover 80 is attached to the left side part 15 to cover the left belt 40, as illustrated by FIG. 5. FIG. 3 also shows the right belt cover 70 covering the right belt 30.

Figure 8:
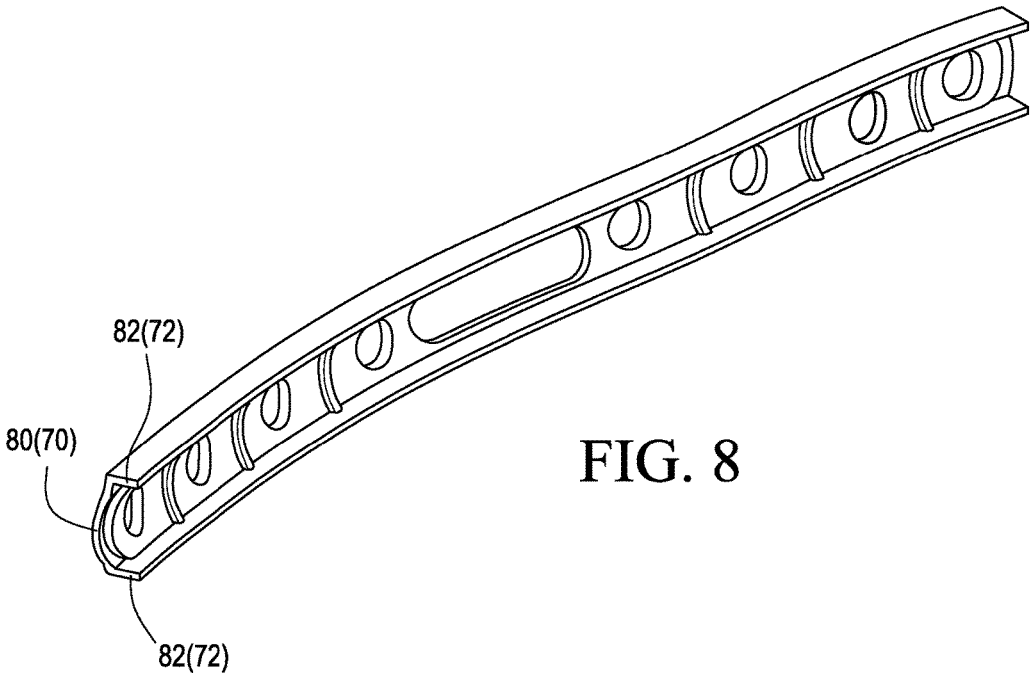
FIG. 8 is a schematic view, illustrating a belt cover formed in a U shape with wings.
Figure 9:
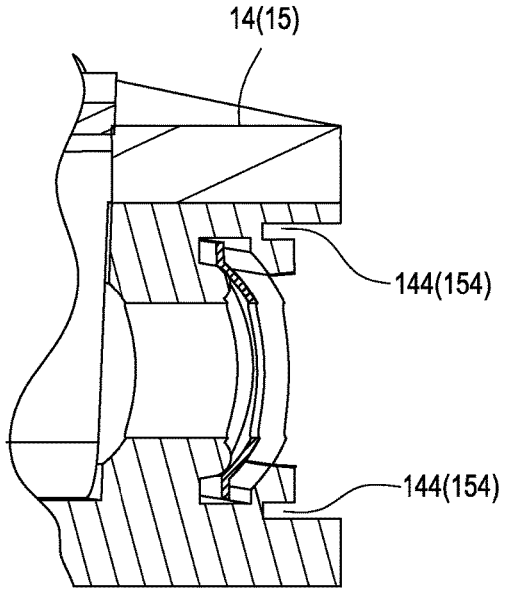
FIG. 9 is a partial sectional view of the bottom pad.

The belts 30 and 40 are maintained to be attached to the peripheral wall 11 of the bottom pad 10 by the belt covers 70 and 80. The right and left belt covers 70 and 80 may be formed in a U shape with wings 72 and 82 as shown in FIG. 8. As shown in FIG. 9, the right side part 14 and the left side part 15 of the peripheral wall 11 may be configured, respectively, to have grooves 144 and 154 to receive the wings 72 or 82 of the corresponding belt cover 70 or 80.

As shown in FIGS. 4 and 5, the bottom pad 10 may be configured to include the belt guides, the O-rings, the concave parts for the air flow roads, and the trenches for better receiving the wave-like ventilation pad. Preferably, the bottom pad 10 may be manufactured, for example by molding, as a single element in a shape to have all of the belt guides, the O-rings, the concave parts and the trenches.

Figure 6E:
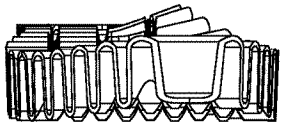
FIG. 6E is a front view of the ventilation pad in FIG. 6A.
Figure 6B:
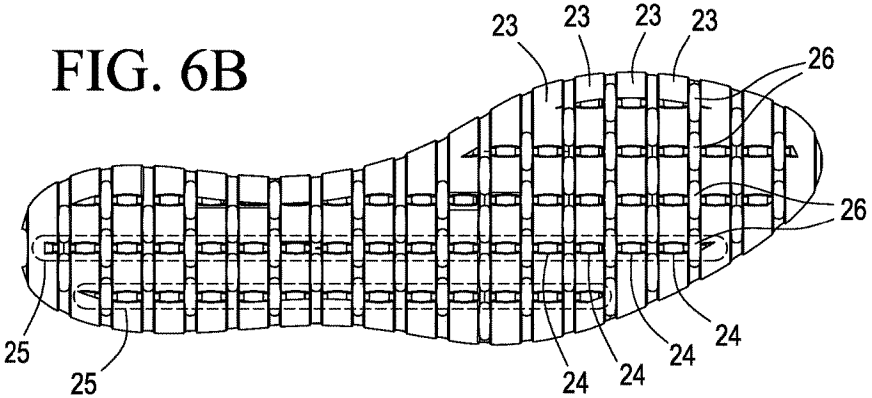
FIG. 6B is a top plan view of the ventilation pad in FIG. 6A.
Figure 6C:
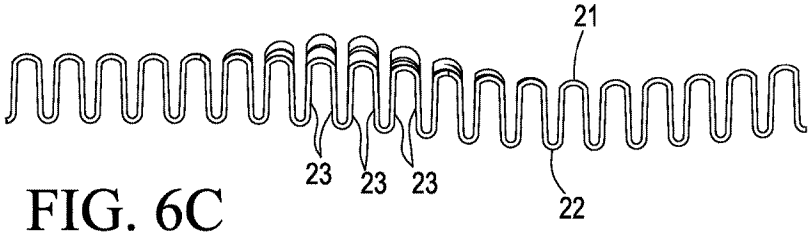
FIG. 6C is a side view of the ventilation pad in FIG. 6A.
Figure 6D:
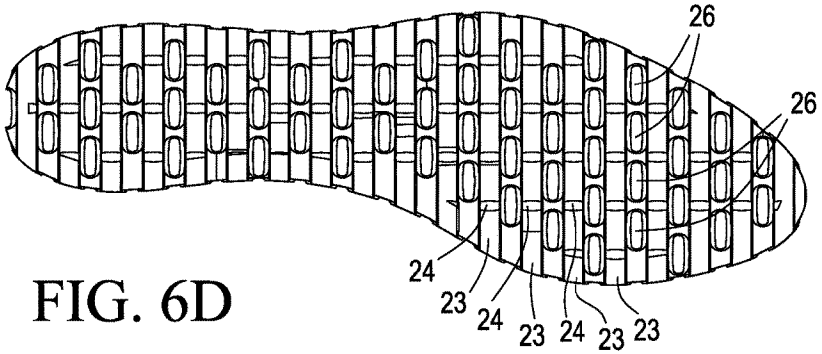
FIG. 6D is a bottom view of the ventilation pad in FIG. 6A.

The ventilation pad 20 is shown in more detail in FIGS. 6A to 6E. FIG. 6A is a perspective view of a ventilation pad of the shoe 1. As shown in FIG. 6B, which is a top plan view of the ventilation pad, the slits 24 of neighboring tunnel vaults 23 are aligned to form a plurality of linear cuts 25 that respectively extend in a direction from the front part 12 to the rear part 13 of the bottom pad 10. As shown in FIG. 6C, which is a side view of the ventilation pad, the ventilation pad 20 extends as a wave-like layer in which a plurality of tunnel vaults 23 are formed in an inverted U shape. The ventilation pad 20 may further include a plurality of bottom holes 26 between two adjacent ones of the tunnel vaults 23, as shown in FIG. 6D, which is a bottom view, as well as in FIG. 6B. FIG. 6E shows a front view of the ventilation pad 20. The air may flow through the slits 24 and holes 26, enhancing the ventilation of the shoe 1.

The pad cover 50 may be disposed on the ventilation pad 20, as shown in FIGS. 2 and 3. The pad cover 50 forms a wave-like layer with a plurality of convex parts 51 corresponding to the plurality of the tunnel vaults 23 of the ventilation pad 20 which are covered by the pad cover 50. Each convex part 51 includes a plurality of cover slits 52.

Figure 10A:
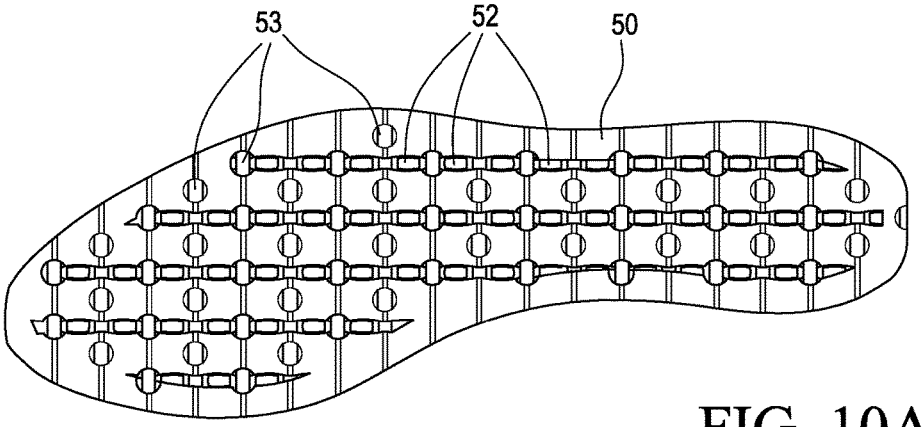
FIGS. 10A and 10B are respectively a plan view of the welt of the shoe of the present invention.
Figure 10B:
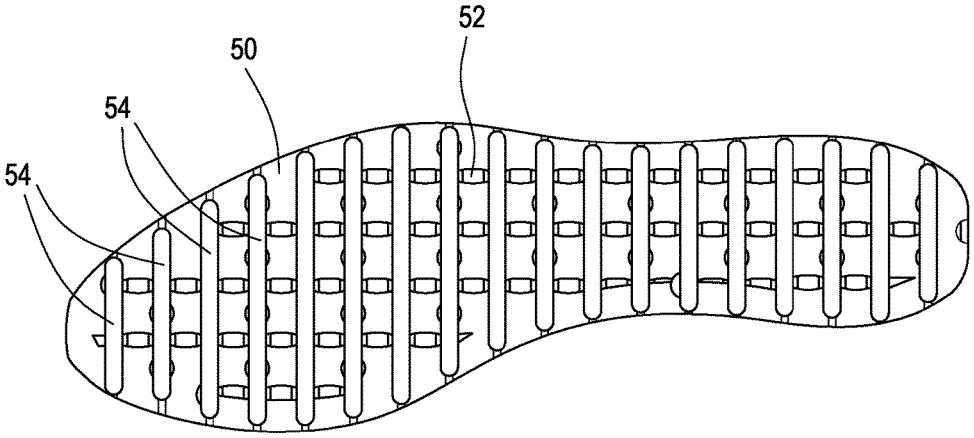

The cover slits 52 may be configured to extend in a direction from the front part 12 to the rear part 13, as shown in FIG. 10A. The pad cover 50 may further include a plurality of cover holes 53 between two adjacent ones of the convex parts 51. The pad cover 50 may include lateral slits 54 between two adjacent ones of the convex parts 51, extending in a direction from the right side part 14 to the left side part 15, as shown in FIG. 10B.

The welt 60 may be disposed on top of the peripheral wall 11 along the periphery of the bottom pad 10 to surround the pad cover 50, as shown in FIGS. 2 and 3. The welt 60 may be formed of material including but not limited to leather.

The right belt 30 and the left belt 40 are respectively disposed on the right side part 14 and the left side part 15 of the peripheral wall 11. The right belt 30 has a plurality of right belt holes 31 to correspond to the right side holes 142 of the bottom pad 20. The right belt 30 is slidably disposed on the peripheral wall 11 of the bottom pad 20, such that the right belt 30 is movable between a first position where the right belt holes 31 are aligned with the right side holes 142 and a second position where the right belt holes 31 are not aligned with the right side holes 142. At the first position, the right side holes 142 are open to an outside via the right belt holes 31 without being blocked or covered by the right belt 30. Air can be supplied into the shoe 1 through the right belt holes 31 and right side holes 142. The O-rings 143 in close contact with the right belt 31 may create a seal at the interface between the peripheral wall 11 and an inner surface of the right belt 30. At the first position, the O-rings 143 may prevent air from leaking at the interface. At the second position, the O-ring 143 may block water from entering the belt holes 31.

The right belt 30 may include a holder 32 which protrudes outward. By pushing or pulling the holder 32, the right belt 30 can move between the first and second positions. The O-rings 143 also facilitates the sliding of the right belt 30 between the first and second positions. Since the O-rings 143 protrude outward and lifts the right belt 30 from the right side part 14, it reduces the contact area or the friction between the right side part 14 and the right belt 30.

Likewise, the left belt 40 has a plurality of left belt holes 41. Preferably, the number of the left belt holes 41 of the left belt 40 is the same as the number of left side holes 152 of the bottom pad 20. The left belt 40 is slidably disposed on the peripheral wall 11 of the bottom pad 20, such that the left belt 40 is movable between a first position where the left belt holes 41 are aligned with the left side holes 152 and a second position where the left belt holes 41 are not aligned with the left side holes 152. At the first position, the left side holes 152 are open to an exterior of the shoe 100 via the left belt holes 41 without being blocked or covered by the left belt 40 or other outer layer, enabling to provide ventilation through the left belt holes 41 and the left side holes 152. The left belt 40 may include a holder 42 similar to the holder 32 of the right belt 30. The left belt 40 is an element separated from the right belt 30 and moves and slides separately from the right belt 30. Accordingly, the opening or closing of the left holes 152 can be made independently from the opening or closing of the right holes 142.

The right belt cover 70 may include a plurality of cover holes 71 which correspond to the plurality of right belt holes 31, and the left belt cover 80 may include a plurality of cover holes 81 which correspond to the plurality of left belt holes 41. At the first position, the right side holes 142 are open to an outside via the right belt holes 31 and the cover holes 71 without being blocked by the right belt 30 or the right belt cover 70.

Further, the right and left belt covers 70 and 80 may include, respectively, an opening 72 or 82 through which the holders 32 and 42 (FIG. 7A) are exposed to an outside.

Figure 7A:
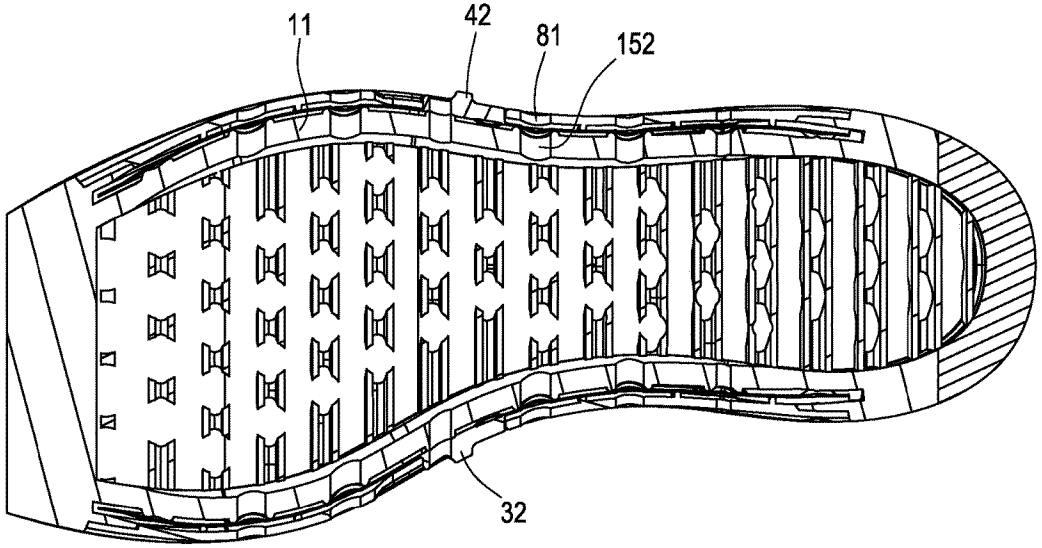
FIG. 7A is another sectional view of the shoe of the invention.
Figure 7B:
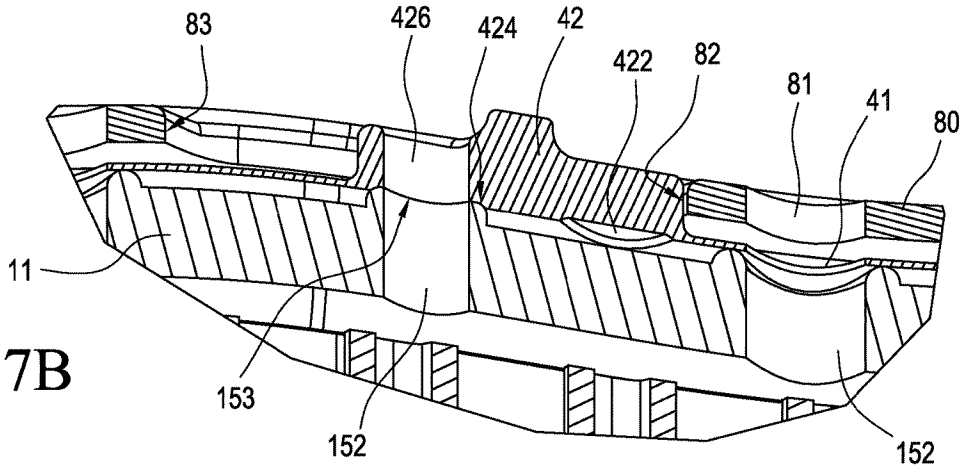
FIG. 7B is an enlarged view of a region A of FIG. 7A.

As shown in FIG. 7A, which is another sectional view of the shoe 1, the left belt 40 is at the first position where the left side holes 152 are aligned with the left belt holes 41 and the cover holes 81, which is shown in more detail by FIG. 7B. The holder 42 of the left belt 40 includes a detent protrusion 422 and a detent notch 424 and the peripheral wall 10 has a detent unit 153. When the detent unit 153 is received in the detent notch 424, the belt 80 is maintained at the first position. When the belt 80 is moved by pulling and pushing the holder 424 to the second position, the detent protrusion 422 may be coupled with the detent unit 153 and the belt 80 is maintained at the second position. The holder 42 of the left belt 40 may include a through hole 426 which is aligned with the left side hole 152 at the first position, so that air can flow through the left side hole 152 and the through hole 426.

The left belt cover 80 may include a plurality of protrusions 83 (FIG. 2) formed between the cover holes 81. The right belt cover 70 may also include a plurality of protrusions (not shown) like the protrusions 83. The protrusions 83 facilitate the belt 80 to smoothly slide between the first and second positions by guiding the belt cover and by reducing the friction between the belt and belt cover.

Figure 11:
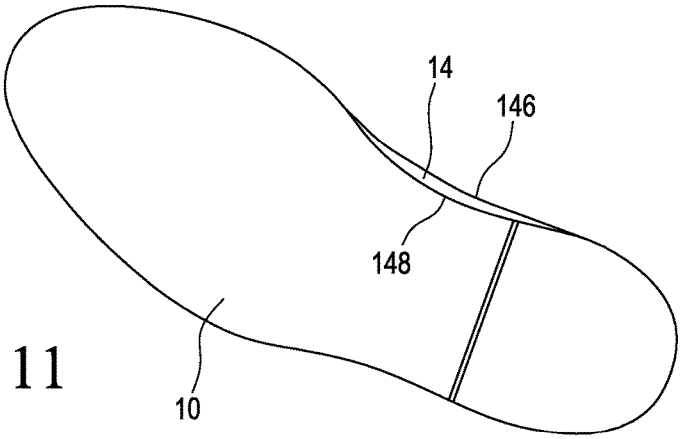
FIG. 11 is a schematic bottom view of the shoe, according to an exemplary embodiment of the present invention.

The peripheral wall 11 may be configured to better facilitate the movement of the belt. For example, as the right side part 14 of the peripheral wall 11 of the bottom pad 10 is more curved, the right belt 30 should be more bent to correspond to the curvature of the outline of the right side part 14 of the peripheral wall 11. The sliding movement of the right belt 30 to change between the first and second positions may not be easily performed. To avoid this problem, an outer face of the right side part 14 may be configured to have a curvature at an upper portion of the peripheral wall 11 smaller than a curvature at a lower portion of the peripheral wall 11. FIG. 11, which is a schematic bottom view of the shoe 1, shows that an upper portion outline 146 of the right side part 14 has a curvature smaller than that of a lower portion outline 148 of the right side part 14.

It should be understood, however, that the invention is not necessarily limited to the specific arrangement and components shown and described above, but may be susceptible to numerous variations within the scope of the invention.

It will be apparent to one skilled in the art that the manner of making and using the claimed invention has been adequately disclosed in the above-written description of the preferred embodiments taken together with the drawings. It will be understood that the above description of the preferred embodiments of the present invention are susceptible to various modifications, changes, and adaptations, and the same are intended to be comprehended within the meaning and range of equivalents of the appended claims.

What is claimed is:

1. A ventilated shoe, comprising:

a bottom pad with a peripheral wall that has a front part, a rear part opposite to the front part, a right side part and a left side part opposite to the right side part, a plurality of right side holes being formed in the right side part of the peripheral wall, a plurality of left side holes being formed in the left side part of the peripheral wall;

a ventilation pad disposed on the bottom pad to be surrounded by the peripheral wall, the ventilation pad forming a wave-like layer with alternate crests and troughs while extending from the front part to the rear part without discontinuity, the troughs being fixed to an upper surface of the bottom pad, the wave-like layer forming a plurality of tunnel vaults each of which extends from the right side part to the left side part, each tunnel vault having a plurality of slits;

a right belt disposed on the right side part of the peripheral wall, the right belt having right belt holes, the right belt being slidable between a first position where the right belt holes are aligned with the right side holes and are open to an outside of the shoe and a second position where the right belt holes are not aligned with the right side holes;

a left belt disposed on the left side part of the peripheral wall, the left belt having left belt holes, the left belt being slidable independently from the right belt between a first position where the left belt holes are aligned with the left side holes and are open to the outside and a second position where the left belt holes are not aligned with the left side holes; and wherein the upper surface of the bottom pad includes a plurality of U shaped trenches to which the ventilation pad is fixed.

2. The ventilated shoe of claim 1, wherein the right side part has a first depressed region and the left side part having a second depressed region, and the right side holes are formed in the first depressed region and the left side holes are formed in the second depressed region.

3. The ventilated shoe of claim 1, wherein, when taken from a plan view of the ventilation pad, the plurality of slits of neighboring ones of the tunnel vaults are aligned to form a plurality of cuts each of which linearly extends in a direction from the front part to the rear part.

4. The ventilated shoe of claim 1, further comprising a pad cover disposed on the ventilation pad, wherein:

the pad cover forms a wave-like layer with a plurality of convex parts corresponding to the plurality of the tunnel vaults;

the convex parts have a plurality of cover slits each of which linearly extends in a direction from the front part to the rear part;

the plurality of cover slits correspond to the plurality of slits of the ventilation pad.

5. The ventilated shoe of claim 4, wherein the pad cover further includes a plurality of cover holes between two adjacent ones of the convex parts.

6. A ventilated shoe, comprising:

a bottom pad with a peripheral wall that has a front part, a rear part opposite to the front part, a right side part and a left side part opposite to the right side part, a plurality of right side holes being formed in the right side part of the peripheral wall, a plurality of left side holes being formed in the left side part of the peripheral wall;

a ventilation pad disposed on the bottom pad to be surrounded by the peripheral wall, the ventilation pad forming a wave-like layer with alternate crests and troughs while extending from the front part to the rear part without discontinuity, the troughs being fixed to an upper surface of the bottom pad, the wave-like layer forming a plurality of tunnel vaults each of which extends from the right side part to the left side part, each tunnel vault having a plurality of slits;

a right belt disposed on the right side part of the peripheral wall, the right belt having right belt holes, the right belt being slidable between a first position where the right belt holes are aligned with the right side holes and are open to an outside of the shoe and a second position where the right belt holes are not aligned with the right side holes;

a left belt disposed on the left side part of the peripheral wall, the left belt having left belt holes, the left belt being slidable independently from the right belt between a first position where the left belt holes are aligned with the left side holes and are open to the outside and a second position where the left belt holes are not aligned with the left side holes; and a pad cover disposed on the ventilation pad, wherein:

the pad cover forms a wave-like layer with a plurality of convex parts corresponding to the plurality of the tunnel vaults;

the convex parts have a plurality of cover slits each of which linearly extends in a direction from the front part to the rear part;

the plurality of cover slits correspond to the plurality of slits of the ventilation pad; and the pad cover further includes a plurality of lateral slits each of which is provided between two adjacent ones of the convex parts and extends in a direction from the right side part to the left side part.

7. The ventilated shoe of claim 1, further comprising a plurality of right side O-rings formed along a circumference of each of the right side holes.

8. The ventilated shoe of claim 1, further comprising a plurality of left side O-rings formed along a circumference of each of the left side holes.

9. The ventilated shoe of claim 1, further comprising:

a right belt cover attached to the right side part to cover the right belt; and a left belt cover attached to the left side part to cover the left belt.

10. The ventilated shoe of claim 9, wherein the right and left belt covers are respectively formed in a U shape with wings.

11. The ventilated shoe of claim 10, wherein the right and left side parts of the peripheral wall, respectively, have grooves to receive the wings of the right and left belt covers.

12. The ventilated shoe of claim 1, wherein the right belt includes a holder which protrudes outward such that the right belt is slidable between the first and second positions by moving the holder.

13. The ventilated shoe of claim 1, wherein the left belt includes a holder which protrudes outward such that the left belt slidable between the first and second positions by moving the holder.

14. The ventilated shoe of claim 9, wherein:

the right belt includes a holder which protrudes outward such that the right belt is slidable between the first and second positions by moving the holder; and the right belt cover includes an opening through which the holder is exposed to an outside.

15. The ventilated shoe of claim 9, wherein:

the left belt includes a holder which protrudes outward such that the left belt slidable between the first and second positions by moving the holder; and the left belt cover includes an opening through which the holder is exposed to an outside.

16. A ventilated shoe, comprising:

a bottom pad with a peripheral wall that has a front part, a rear part opposite to the front part, a right side part and a left side part opposite to the right side part, a plurality of right side holes being formed in the right side part of the peripheral wall, a plurality of left side holes being formed in the left side part of the peripheral wall;

a ventilation pad disposed on the bottom pad to be surrounded by the peripheral wall, the ventilation pad forming a wave-like layer with alternate crests and troughs while extending from the front part to the rear part without discontinuity, the troughs being fixed to an upper surface of the bottom pad, the wave-like layer forming a plurality of tunnel vaults each of which extends from the right side part to the left side part, each tunnel vault having a plurality of slits;

a right belt disposed on the right side part of the peripheral wall, the right belt having right belt holes, the right belt being slidable between a first position where the right belt holes are aligned with the right side holes and are open to an outside of the shoe and a second position where the right belt holes are not aligned with the right side holes;

a left belt disposed on the left side part of the peripheral wall, the left belt having left belt holes, the left belt being slidable independently from the right belt between a first position where the left belt holes are aligned with the left side holes and are open to the outside and a second position where the left belt holes are not aligned with the left side holes;

a right belt cover attached to the right side part to cover the right belt; and a left belt cover attached to the left side part to cover the left belt;

wherein:

the right belt cover includes a plurality of right cover holes corresponding to the plurality of right belt holes; and at the first position of the right belt, the right side holes are open to an outside via the right belt holes and the cover holes.

17. A ventilated shoe, comprising:

a bottom pad with a peripheral wall that has a front part, a rear part opposite to the front part, a right side part and a left side part opposite to the right side part, a plurality of right side holes being formed in the right side part of the peripheral wall, a plurality of left side holes being formed in the left side part of the peripheral wall;

a ventilation pad disposed on the bottom pad to be surrounded by the peripheral wall, the ventilation pad forming a wave-like layer with alternate crests and troughs while extending from the front part to the rear part without discontinuity, the troughs being fixed to an upper surface of the bottom pad, the wave-like layer forming a plurality of tunnel vaults each of which extends from the right side part to the left side part, each tunnel vault having a plurality of slits;

a right belt disposed on the right side part of the peripheral wall, the right belt having right belt holes, the right belt being slidable between a first position where the right belt holes are aligned with the right side holes and are open to an outside of the shoe and a second position where the right belt holes are not aligned with the right side holes;

a left belt disposed on the left side part of the peripheral wall, the left belt having left belt holes, the left belt being slidable independently from the right belt between a first position where the left belt holes are aligned with the left side holes and are open to the outside and a second position where the left belt holes are not aligned with the left side holes;

a right belt cover attached to the right side part to cover the right belt; and a left belt cover attached to the left side part to cover the left belt;

wherein:

the left belt cover includes a plurality of left cover holes corresponding to the plurality of left belt holes; and at the first position of the left belt, the left side holes are open to an outside via the left belt holes and the left cover holes.

18. A ventilated shoe, comprising:

a bottom pad with a peripheral wall that has a front part, a rear part opposite to the front part, a right side part and a left side part opposite to the right side part, a plurality of right side holes being formed in the right side part of the peripheral wall, a plurality of left side holes being formed in the left side part of the peripheral wall;

a ventilation pad disposed on the bottom pad to be surrounded by the peripheral wall, the ventilation pad forming a wave-like layer with alternate crests and troughs while extending from the front part to the rear part without discontinuity, the troughs being fixed to an upper surface of the bottom pad, the wave-like layer forming a plurality of tunnel vaults each of which extends from the right side part to the left side part, each tunnel vault having a plurality of slits;

a right belt disposed on the right side part of the peripheral wall, the right belt having right belt holes, the right belt being slidable between a first position where the right belt holes are aligned with the right side holes and are open to an outside of the shoe and a second position where the right belt holes are not aligned with the right side holes;

a left belt disposed on the left side part of the peripheral wall, the left belt having left belt holes, the left belt being slidable independently from the right belt between a first position where the left belt holes are aligned with the left side holes and are open to the outside and a second position where the left belt holes are not aligned with the left side holes;

a right belt cover attached to the right side part to cover the right belt; and a left belt cover attached to the left side part to cover the left belt;

wherein:

the left belt includes a holder which protrudes outward such that the left belt slidable between the first and second positions by moving the holder;

the left belt cover includes an opening through which the holder is exposed to an outside; and the holder of the left belt includes a through hole which is aligned with the left side hole at the first position.

19. The ventilated shoe of claim 1, wherein an outer face of the right side part is configured to have a curvature at an upper portion of the peripheral wall smaller than a curvature at a lower portion of the peripheral wall.

20. The ventilated shoe of claim 1, wherein an inner surface of the right and left side parts of the peripheral wall respectively has a concave portion to form an air flow road.

21. A ventilated shoe, comprising:

a bottom pad with a peripheral wall that has a front part, a rear part opposite to the front part, a right side part and a left side part opposite to the right side part, a plurality of right side holes being formed in the right side part of the peripheral wall, a plurality of left side holes being formed in the left side part of the peripheral wall;

a ventilation pad disposed on the bottom pad to be surrounded by the peripheral wall, the ventilation pad forming a wave-like layer with alternate crests and troughs while extending from the front part to the rear part without discontinuity, the troughs being fixed to an upper surface of the bottom pad, the wave-like layer forming a plurality of tunnel vaults each of which extends from the right side part to the left side part, each tunnel vault having a plurality of slits;

a right belt disposed on the right side part of the peripheral wall, the right belt having right belt holes, the right belt being slidable between a first position where the right belt holes are aligned with the right side holes and are open to an outside of the shoe and a second position where the right belt holes are not aligned with the right side holes; and a left belt disposed on the left side part of the peripheral wall, the left belt having left belt holes, the left belt being slidable independently from the right belt between a first position where the left belt holes are aligned with the left side holes and are open to the outside and a second position where the left belt holes are not aligned with the left side holes, wherein:

the right side part has a first belt guide and the left side part has a second belt guide, the right side holes being formed in the first belt guide, the left side holes being formed in the second belt guide;

a plurality of right side O-rings are formed along a circumference of each of the right side holes and a plurality of left side O-rings are formed along a circumference of each of the left side holes;

an inner surface of the right and left side parts respectively has a concave portion to form an air flow road;

the upper surface of the bottom pad includes a plurality of U shaped trenches to which the ventilation pad is fixed; and the bottom pad is a single element in a shape that includes all of the belt guides, the right and left side O-rings, the concave portion, and the U shaped trenches.

* * * * *